US010454181B2

(12) United States Patent
Kim et al.

(10) Patent No.: US 10,454,181 B2
(45) Date of Patent: Oct. 22, 2019

(54) DIELECTRIC COUPLING LENS USING DIELECTRIC RESONATORS OF HIGH PERMITTIVITY

(71) Applicant: 3M INNOVATIVE PROPERTIES COMPANY, St. Paul, MN (US)

(72) Inventors: Jaewon Kim, Woodbury, MN (US); Douglas B. Gundel, Cedar Park, TX (US); Ronald D. Jesme, Plymouth, MN (US); Justin M. Johnson, Hudson, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 176 days.

(21) Appl. No.: 15/537,652

(22) PCT Filed: Jan. 13, 2015

(86) PCT No.: PCT/US2015/011089

§ 371 (c)(1),
(2) Date: Jun. 19, 2017

(87) PCT Pub. No.: WO2016/114756

PCT Pub. Date: Jul. 21, 2016

(65) Prior Publication Data

US 2017/0346190 A1 Nov. 30, 2017

(51) Int. Cl.
*H01Q 1/36* (2006.01)
*H01Q 19/06* (2006.01)
(Continued)

(52) U.S. Cl.
CPC ..... *H01Q 19/062* (2013.01); *H01P 3/12* (2013.01); *H01Q 1/36* (2013.01); *H01Q 13/06* (2013.01);
(Continued)

(58) Field of Classification Search
CPC ..... H01Q 19/062; H01Q 1/36; H01Q 13/06; H01Q 15/10; H01Q 15/0087
See application file for complete search history.

(56) References Cited

U.S. PATENT DOCUMENTS 5,867,120 A 2/1999 Ishikawa
6,093,246 A * 7/2000 Lin ..... B82Y 20/00 117/92
7,057,479 B2 6/2006 Furuya

FOREIGN PATENT DOCUMENTS

JP 1991(H03)-128305 U 12/1991
JP 2001-160704 A 6/2001
(Continued)

OTHER PUBLICATIONS

Dolatsha, "Dielectric Wveguide with Planar Multi-Mode Excitation for High Data-Rate Chip-to-Chip Interconnects", Sep. 1, 2013 IEEE International Conference on Ultra-Wideband (ICUWB), pp. 184-188, XP055170498.
(Continued)

*Primary Examiner* — Graham P Smith
(74) *Attorney, Agent, or Firm* — X. Christina Huang

(57) ABSTRACT

Techniques are described for a lens containing high dielectric resonators. In one example, a lens comprises a substrate for propagating an electromagnetic wave and a plurality of resonators dispersed throughout the substrate. Each of the plurality of resonators has a diameter selected based at least in part on a wavelength of the electromagnetic wave and is formed of a dielectric material having a resonance frequency selected based at least in part on a frequency of the electromagnetic wave. Each of the plurality of resonators also has a relative permittivity that is greater than a relative permittivity of the substrate. At least two of the plurality of resonators are spaced within the substrate according to a lattice constant that defines a distance between a center of a
(Continued)

first one of the resonators and a center of a neighboring second one of the resonators.

20 Claims, 7 Drawing Sheets

(51) Int. Cl.

| | |
|---|---|
| ***H01Q 13/06*** | (2006.01) |
| ***H01Q 15/10*** | (2006.01) |
| ***H01P 3/12*** | (2006.01) |
| ***H01Q 21/00*** | (2006.01) |
| *H01P 5/08* | (2006.01) |

(52) U.S. Cl.
CPC ..... *H01Q 15/10* (2013.01); *H01Q 21/0087* (2013.01); *H01P 5/08* (2013.01)

(56) References Cited

FOREIGN PATENT DOCUMENTS

JP 2011-041100 A 2/2011

WO WO 2013/133175 A 9/2013

OTHER PUBLICATIONS

Kim, "Application of cubic high dielectric resonator metamaterial to antennas", 2007 IEEE Antennas and Propagation International Symposium, Jan. 2007, pp. 2349-2352.

Fukuda, "A 12.5+12.5 Gb/s Full-Duplex Plastic Waveguide Interconnect", IEEE Journal of Solid-State Circuits, Dec. 2011, vol. 46, No. 12, pp. 3113-3125.

Takano, "Fabrication and Performance of TiO2 Ceramic-Based Metamaterials for Terahertz Frequency Range", IEEE Transactions on Terahertz Science and Technology, Nov. 2013, vol. 3, No. 6, pp. 812-819.

Holloway, "A Double Negative (DNG) Composite Medium Composed of Magnetodielectric Spherical Particles Embedded in a Matrix". IEEE Transactions on Antennas and Propagation, Oct. 2003, vol. 51, No. 10, pp. 2596-2603.

International Search Report for PCT International Application No. PCT/US2015/011089, dated Sep. 2, 2015, 3pgs.

* cited by examiner

DIELECTRIC COUPLING LENS USING DIELECTRIC RESONATORS OF HIGH PERMITTIVITY

CROSS REFERENCE TO RELATED APPLICATIONS

This application is a national stage filing under 35 U.S.C. 371 of PCT/US2015/011089, filed Jan. 13, 2015, the disclosure of which is incorporated by reference in its entirety herein.

TECHNICAL FIELD

The disclosure relates to wave focusing techniques.

BACKGROUND

Available radio-frequency spectra are frequently limited by jurisdictional regulations and standards. The increasing demand for bandwidth (i.e., increased data throughput) leads to the emergence of a number of wireless point-to-point technologies that offer fiber data rates and can support dense deployment architectures Millimeter wave communication systems can be used for this function, providing operational benefits of short link, high data rate, low cost, high density, high security, and low transmission power.

These advantages make millimeter wave communication systems beneficial for sending various waves in the radio-frequency spectrum. Coaxial cables are available for carrying millimeter waves, though the cables are currently very expensive to incorporate in a millimeter wave communication system.

SUMMARY

In general, the disclosure relates to a lens containing high dielectric resonators. The lens comprises a substrate and a plurality of high dielectric resonators dispersed throughout the substrate, wherein each high dielectric resonator in the plurality of high dielectric resonators has a relative permittivity that is high relative to a relative permittivity of the substrate, and wherein the plurality of high dielectric resonators are arranged in a geometric pattern in such a way that the resonance of one high dielectric resonator transfers energy to any surrounding high dielectric resonators.

In one embodiment, the disclosure is directed to a lens containing high dielectric resonators. In one example, a lens comprises a substrate for propagating an electromagnetic wave and a plurality of resonators dispersed throughout the substrate. Each of the plurality of resonators has a diameter selected based at least in part on a wavelength of the electromagnetic wave and is formed of a dielectric material having a resonance frequency selected based at least in part on a frequency of the electromagnetic wave. Each of the plurality of resonators also has a relative permittivity that is greater than a relative permittivity of the substrate. At least two of the plurality of resonators are spaced within the substrate according to a lattice constant that defines a distance between a center of a first one of the resonators and a center of a neighboring second one of the resonators.

In another embodiment, the disclosure is directed to a waveguide system apparatus. The apparatus comprises a waveguide, an antenna, and a lens positioned between the antenna and the waveguide. The lens comprises a substrate for propagating an electromagnetic wave sent or received by the antenna and a plurality of resonators dispersed throughout the substrate. Each of the plurality of resonators has a diameter selected based at least in part on a wavelength of the electromagnetic wave and is formed of a dielectric material having a resonance frequency selected based at least in part on a frequency of the electromagnetic wave. Each of the plurality of high dielectric resonators has a relative permittivity that is greater than a relative permittivity of the substrate. At least two of the plurality of resonators are spaced within the substrate according to a lattice constant that defines a distance between a center of a first one of the resonators and a center of a neighboring second one of the resonators.

In another embodiment, the disclosure is directed to a method of forming a lens. The method comprises forming a plurality of resonators of a dielectric material having a resonance frequency selected based at least in part on a frequency of an electromagnetic wave with which the lens is to be used. Each of the resonators has a diameter that is selected based at least in part on a wavelength of the electromagnetic wave. Each of the plurality of resonators has a relative permittivity that is greater than a relative permittivity of the substrate. At least two of the plurality of resonators are arranged to be spaced within the substrate according to a lattice constant that defines a distance between a center of a first one of the resonators and a center of a neighboring second one of the resonators.

The details of one or more embodiments of the disclosure are set forth in the accompanying drawings and the description below. Other features, objects, and advantages of the disclosure will be apparent from the description and drawings, and from the claims.

DETAILED DESCRIPTION

The present disclosure describes a lens structure that can be used to improve coupling efficiency between antennas and waveguides. The lens structure includes a substrate formed of a material having a low relative permittivity, and a plurality of high dielectric resonators (HDRs) spaced within the substrate in such a way as to allow energy transfer between HDRs. HDRs are objects that are crafted to resonate at a particular frequency, and may be constructed of a ceramic-type material, for example. When an electromagnetic (EM) wave having a frequency at or near to that of the resonance frequency of an HDR passes through the HDR, the energy of the wave is magnified. When the energy transfer between HDRs is taken in combination with the magnification of the EM wave energy due to the resonance of the HDRs, the EM wave has a power ratio of more than three times the power ratio of a wave that passes through a waveguide alone. Using this lens structure as an interface between a waveguide and an antenna produces a low-loss and low-reflection alternative to coaxial cables and other point-to-point technologies in various communication systems.

Figure 1:
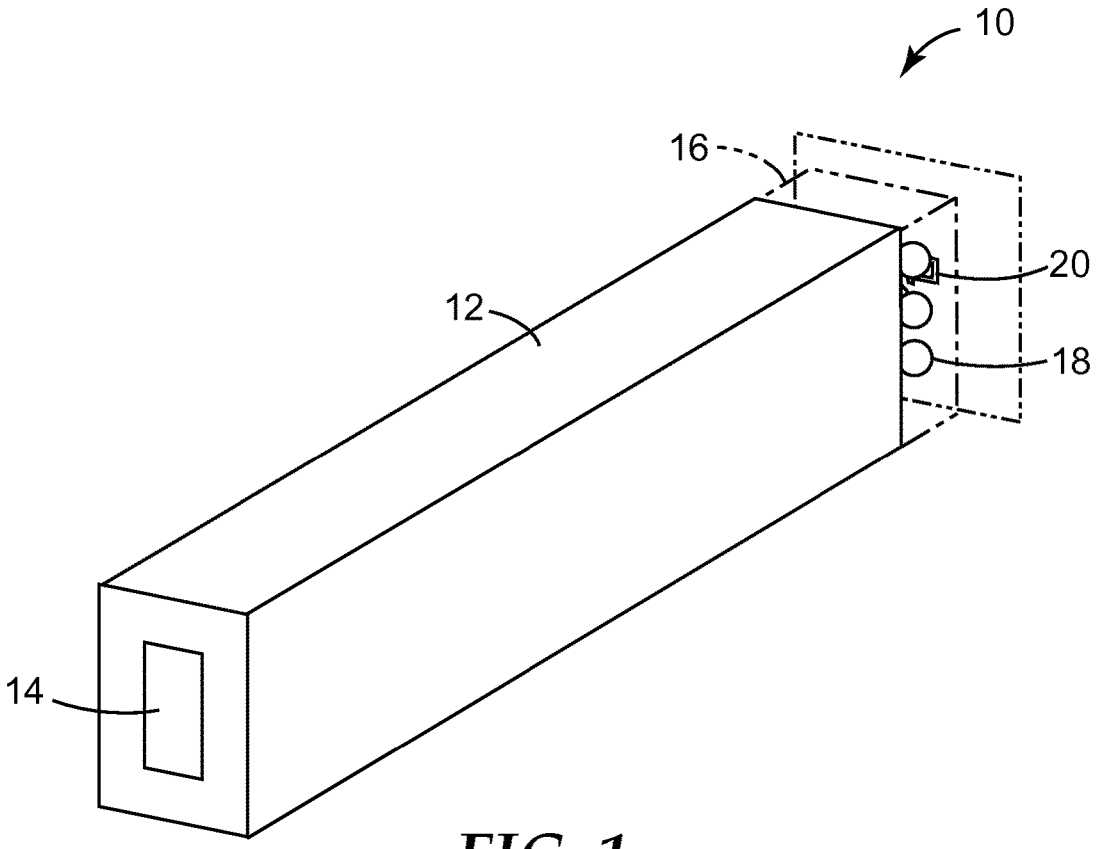
FIG. 1 is a block diagram illustrating an example system that includes a waveguide and a dielectric coupling lens with high dielectric resonators, in accordance with one or more techniques of this disclosure.

FIG. 1 is a block diagram illustrating an example system that includes a waveguide and a dielectric coupling lens with high dielectric resonators, in accordance with one or more techniques of this disclosure. In this system 10, waveguide 12 has a port 14 that extends through waveguide 12. Lens 16 is positioned between waveguide 12 and antenna 20. Lens 16 includes a plurality of HDRs 18 that are distributed throughout lens 16 in a geometric pattern. Lens 16 receives a signal from antenna 20, which propagates through HDRs 18 and into a first end of waveguide 12. The signal could be an electromagnetic wave, or an acoustic wave, among other things. In some examples, the signal is a 60 GHz millimeter wave signal. The signal exits waveguide 12 through port 14.

Waveguide 12 is a structure that guides waves. Waveguide 12 generally confines the signal to travel in one dimension. Waves typically propagate in all directions as spherical waves when in open space. When this happens, waves lose their power proportionally to the square of the distance traveled. Under ideal conditions, when a waveguide confines a wave to traveling in only a single direction, the wave loses little to no power while propagating.

Waveguide 12 is a structure with an opening at each end of its length, the two openings, i.e., ports (such as port 14), being connected by a hollow portion along the length of the interior of the waveguide 12. Waveguide 12 can be made of copper, brass, silver, aluminum, for example, or other metal having a low bulk resistivity. In some examples, waveguide 12 can be made of metal with poor conductivity characteristics, plastic, or other non-conductive materials, if the interior walls of the waveguide 12 are plated with a low bulk resistivity metal. In one example, waveguide 12 has a size of 2.5 mm×1.25 mm, and is made of Teflon®, having a relative permittivity, Er, =2.1 and a loss tangent=0.0002, with 1 mm thick Aluminum cladding on the interior walls of waveguide 12.

Lens 16 is a structure made of a low relative permittivity material substrate, such as Teflon®, for example. In other examples, the substrate portion of lens 16 may be made of materials such as quartz glass, cordierite, borosilicate glass, perfluoroalkoxy, polyethylene, or fluorinated ethylene propylene, for example. In some examples, lens 16 has a trapezoidal shape, with a tapered end positioned proximate to one end of waveguide 12. In other examples, lens 16 has a rectangular shape. Other examples could feature a lens with other various shapes. In one example, lens 16 is formed of a Teflon® substrate 2 mm in length, with HDR spheres having a radius of 0.35 mm, with spacing between antenna 20 and lens 16 being 1.35 mm.

In some embodiments, lens 16 contains a plurality of HDRs 18 arranged within the substrate in a geometric pattern. In general, to improve the coupling efficiency, the geometric pattern may be designed to fit a waveguide size. In some examples, this pattern is a three-by-three grid of equally spaced HDRs 18 in a vertical plane furthest away from waveguide 12 and a vertical line of three equally spaced HDRs 18 located centrally aligned between the three-by-three grid and the waveguide 12, where the vertical line of three equally spaced HDRs 18 fits the size of waveguide 12 and port 14. This geometric pattern may have a focusing benefit. From a top view, the arrangement of HDRs takes the form of a triangle. EM waves, specifically those at or near the resonant frequencies of the HDRs, are caught by any of the nine HDRs in the front portion of lens 16 proximate to the antenna. In some examples, the resonance frequency is selected to match the frequency of the electromagnetic wave. In some examples, the resonance frequency of the plurality of resonators is within a millimeter wave band. In one example, the resonance frequency of the plurality of resonators is 60 GHz. Each of these HDRs may then refract the wave towards the respective HDR having the same vertical placement in the singular vertical line of three equally spaced HDRs. Standing waves are formed in lens 16 that oscillate with large amplitudes. This magnifies the strength of the EM wave even further before finally focusing the wave into waveguide 12 via port 14.

HDRs 18 can also be arranged in other geometric patterns with specific spacing. For example, in some examples a vertical line of two spheres may be used if needed, such as to fit the size of waveguide 12. The HDRs 18 may be spaced in such a way that the resonance of one HDR transfers energy to any surrounding HDR. This spacing is related to Mie resonance of the HDRs 18 and system efficiency. The spacing may be chosen to improve the system efficiency by considering the wavelength of any electromagnetic wave in the system. Each HDR 18 has a diameter and a lattice constant. In some examples, the lattice constant and the resonance frequency are selected based at least in part on the waveguide with which the lens is to be used. The lattice constant is a distance from the center of one HDR to the center of a neighboring HDR. In some examples, HDRs 18 may have a lattice constant of 1 mm. In some examples, the lattice constant is less than the wavelength of the electromagnetic wave.

The ratio of the diameter of the HDR and the lattice constant of the HDRs (diameter D/lattice constant a) can be used to characterize the geometric arrangement of HDRs 18 in lens 16. This ratio may vary with the relative permittivity contrast of the lens structure. In some examples, the ratio of the diameter of the resonators to the lattice constant is less than one. In one example, D may be 0.7 mm and a may be 1 mm, with a ratio of 0.7. The higher that this ratio is, the lower the coupling efficiency of the lens becomes. In one example, the maximum limit of the lattice constant for the geometric arrangement of HDRs 18 as shown in FIG. 1 will be the wavelength of the emitted wave. The lattice constant should be less than the wavelength, but for a strong efficiency, the lattice constant should be much smaller than the wavelength. The relative size of these parameters may vary with the relative permittivity contrast of the lens structure. The lattice constant may be selected to achieve the desired performance within the wavelength of the emitted wave. In one example, the lattice constant may be 1 mm and the wavelength may be 5 mm, i.e., a lattice constant that is one fifth of the wavelength. Generally, the wavelength ($\lambda$) is the wavelength in air medium. If another dielectric material is used for the medium, the wavelength for this formula should be replaced by $\lambda_{eff}$, which is:

$$\lambda_{eff} = \frac{\lambda}{\sqrt{\varepsilon_r}}$$

where $\varepsilon_r$ is the relative permittivity of the medium material.

A high relative permittivity contrast between HDRs 18 and the substrate of lens 16 causes excitement in the well-defined resonance modes of the HDRs 18. In other words, the material of which HDRs 18 are formed has a high relative permittivity relative to the relative permittivity of the material of the substrate of lens 16. A higher contrast will provide higher performance and so, the relative permittivity of HDRs 18 is an important parameter in determining the resonant properties of HDRs 18. A low contrast may result in a weak resonance for HDRs 18 because energy will leak into the substrate material of lens 16. A high contrast provides an approximation of a perfect boundary condition, meaning little to no energy is leaked into the substrate material of lens 16. This approximation can be assumed for an example where the material forming HDRs 18 has a relative permittivity more than a 5-10 times of a relative permittivity of the substrate of lens 16. In some examples, each of the plurality of resonators has a relative permittivity that is from at least two times greater than a relative permittivity of the substrate. In other examples, each of the plurality of resonators has a relative permittivity that is at least ten times greater than a relative permittivity of the substrate. For a given resonant frequency, the higher the relative permittivity, the smaller the dielectric resonator, and the energy is more concentrated within the dielectric resonator. In some examples, the plurality of resonators are made of a ceramic material. HDRs 18 can be made of any of a variety of ceramic materials, for example, including BaZnTa oxide, BaZnCoNb, Zrtitanium-based materials, Titanium-based materials, Barium Titanate-based materials, Titanium oxide-based materials, Y5V, and X7R, for example, among other things. In one example, HDRs 18 may have a relative permittivity of 40.

Although illustrated in FIG. 1 for purposes of example as being spherical, in other examples HDRs 18 may be formed in various different shapes. In other examples, each of HDRs 18 may have a cylindrical shape. In still other examples, each of HDRs 18 may have a cubic or other parallelepiped shape. HDRs 18 could take other geometric shapes. The functionality of the HDRs 18 may vary depending on the shape, as described in further detail below with respect to FIG. 5.

Antenna 20 can be a device that emits a signal of electromagnetic waves. Antenna 20 could also be a device that receives waves from waveguide 12 via port 14 and lens 16. The waves could be any electromagnetic waves in the radio-frequency spectrum, for example, including 60 GHz millimeter waves. So long as the HDR diameter and lattice constant follow the constraints stated above, lens 16 of system 10 can be used for any wave in a band of radio-frequency spectra, for example. In some examples, lens 16 may be useful in the millimeter wave band of the electromagnetic spectrum. In some examples, lens 16 may be used with signals at frequencies ranging from 10 GHz to 120 GHz, for example. In other examples, lens 16 may be used with signals at frequencies ranging from 10 GHz to 300 GHz, for example.

Lens 16 having HDRs 18 could be used in a variety of systems, including, for example, low cost cable markets, contactless measurement applications, chip-to-chip communications, and various other wireless point-to-point applications that offer fiber data rates and can support dense deployment architectures.

In some examples, a lens such as lens 16 of FIG. 1 may be formed to include a substrate and a plurality of high dielectric resonators, wherein an arrangement of the HDRs within the substrate is controlled during formation such that the HDRs are spaced apart from one another at selected distances. The distances between HDRs, i.e., the lattice constant, may be selected based on a wavelength of an electromagnetic wave signal with which the lens is to be used. For example, lattice constant may be much smaller than the wavelength. In some examples, during formation of lens 16, the substrate material of lens 16 may be divided into multiple portions. Where there is a determination of a location of a plane of HDRs, the substrate material may be segmented. Hemi-spherical grooves may be included in multiple portions of substrate material at the location of each HDR. In other examples with differently shaped HDRs, hemi-cylindrical or hemi-rectangular grooves may be included in the substrate material. HDRs may then be placed in the grooves of the substrate material. The multiple portions of substrate material may then be combined to form a singular lens structure with HDRs embedded throughout.

In one example, in accordance with one or more techniques of this disclosure, a lens (e.g., lens 16) is disclosed comprising a substrate for propagating an electromagnetic wave and a plurality of resonators (e.g., HDRs 18) dispersed throughout the substrate. Each of the plurality of resonators has a diameter selected based at least in part on a wavelength of the electromagnetic wave and is formed of a dielectric material having a resonance frequency selected based at least in part on a frequency of the electromagnetic wave. Each of the plurality of resonators also has a relative permittivity that is greater than a relative permittivity of the substrate. At least two of the plurality of resonators are spaced within the substrate according to a lattice constant that defines a distance between a center of a first one of the resonators and a center of a neighboring second one of the resonators. In some examples, in accordance with one or more techniques of this disclosure, this lens may be used as part of a system to couple a waveguide to an antenna by being positioned between the antenna and the waveguide.

This lens is formed, in accordance with one or more techniques of this disclosure, by forming a plurality of resonators of a dielectric material having a resonance frequency selected based at least in part on a frequency of an electromagnetic wave with which the lens is to be used. Each of the resonators has a diameter that is selected based at least in part on a wavelength of the electromagnetic wave. Each of the plurality of resonators has a relative permittivity that is greater than a relative permittivity of the substrate. At least two of the plurality of resonators are arranged to be spaced within the substrate according to a lattice constant that defines a distance between a center of a first one of the resonators and a center of a neighboring second one of the resonators.

Figure 2A:
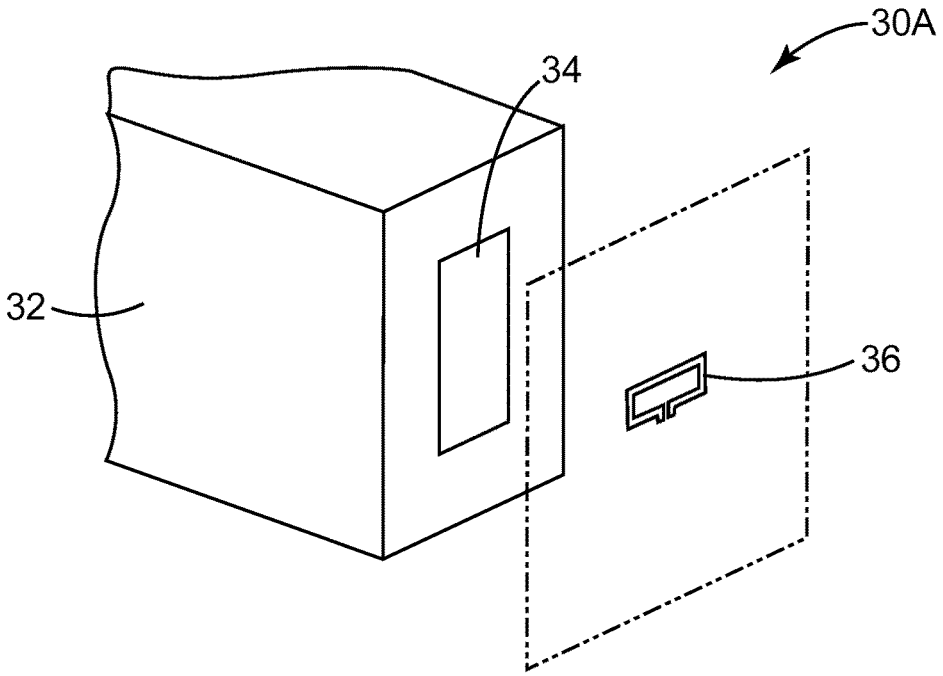
FIGS. 2A-2D are block diagrams illustrating example arrangements of components such as a waveguide, a lens, and an antenna, in accordance with one or more techniques of this disclosure.

FIGS. 2A-2D are block diagrams illustrating various example arrangements of components such as a waveguide, a lens, and an antenna, in accordance with one or more techniques of this disclosure. FIG. 2A is a block diagram illustrating an example waveguide system that does not include a lens between a waveguide 32 and an antenna 36. In this example system 30A, waveguide 32 has a port 34 at a first end revealing a hollow interior. This hollow interior runs the entire length of waveguide 32 and leads to another port at a second end of waveguide 32. Antenna 36 may emit a signal as spherical waves, for example. Some of these spherical waves enter waveguide 32 through port 34, where they are focused to propagate in one direction to conserve energy. Many other spherical waves may be lost due to the manner in which antenna 36 emits signals, and the wave magnitude may decrease greatly due to spherical waves losing power proportionally to the square of the distance traveled when the waves are not focused.

Figure 2B:
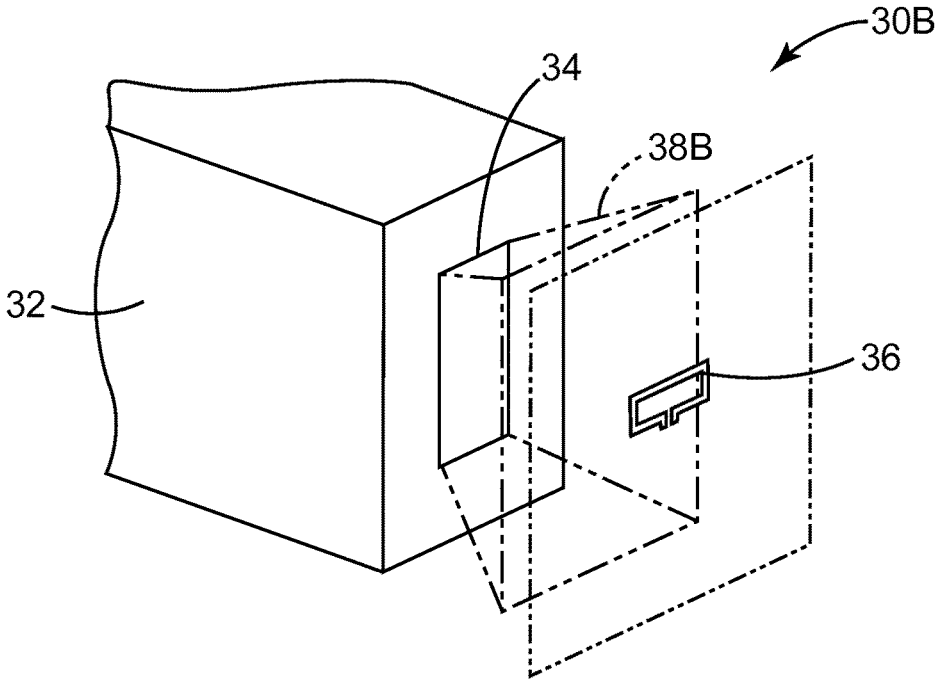

FIG. 2B is a block diagram illustrating an example waveguide system that includes a trapezoidal low relative permittivity material substrate lens 38B. In the example of FIG. 2, lens 38B does not include any HDR elements within the lens. In system 30B, lens 38B is formed in the shape of a three-dimensional trapezoid, and is positioned between waveguide 32 and antenna 36. A tapered end of the trapezoidal lens 38B is proximate to port 34 of waveguide 32, and a larger end of the trapezoidal lens 38B is proximate to antenna 36. Antenna 36 emits a signal as spherical waves, for example. Some of these spherical waves are received by lens 38B, which focuses the spherical waves at or near port 34 of waveguide 32, increasing the magnitude of energy passing through waveguide 32 as compared to system 30A of FIG. 2A in which no lens 38B is present.

Figure 2C:
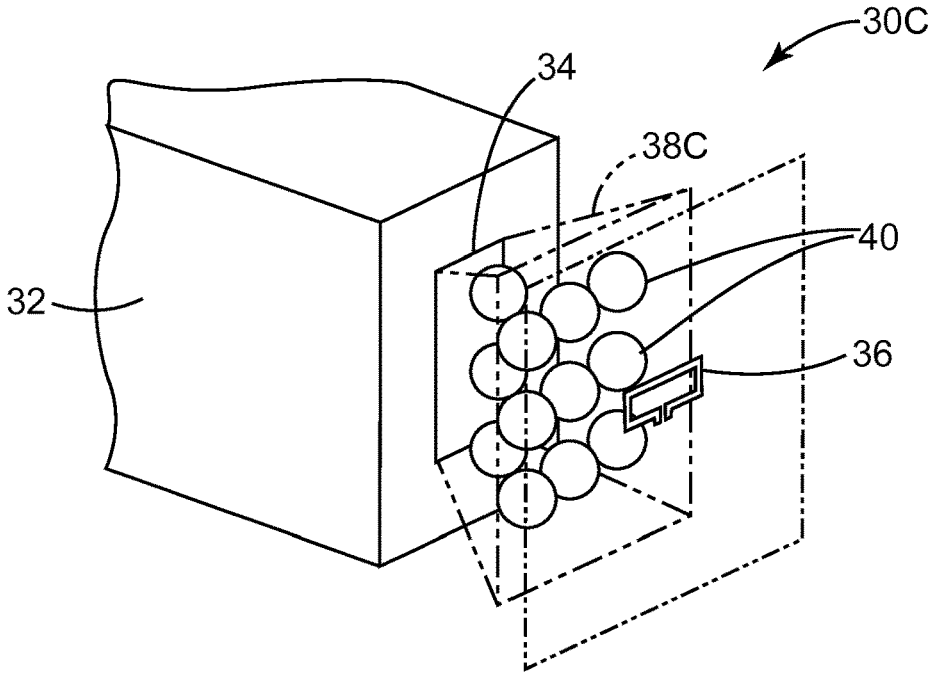

FIG. 2C is a block diagram illustrating an example waveguide system that includes a trapezoidal low relative permittivity material substrate lens 38C that includes a plurality of HDRs arranged within lens 38C, in accordance with one or more techniques of this disclosure. In system 30C, lens 38C is formed in the shape of a three-dimensional trapezoid and is positioned between waveguide 32 and antenna 36. The tapered end of the trapezoidal lens 38C is proximate to port 34 of waveguide 32, with the larger end of the trapezoidal lens 38C proximate to antenna 36. HDRs 40 are arranged within lens 38C, and HDRs 40 are configured to resonate at the same frequency as the waves emitted by antenna 36. HDRs 40 are formed of a material having a high relative permittivity relative to a relative permittivity of the substrate material of lens 38C. HDRs 40 are evenly spaced within lens 38C in such a way that, when HDRs 40 begin resonating and form standing waves with large oscillating amplitudes due to incident waves having a frequency at or near to the resonance frequency of the HDRs 40, energy is transferred between the individual HDRs 40 towards waveguide 32. In some examples, the presence of HDRs 40 in lens 38C increases the magnitude of waves passing through waveguide 32 by a factor of almost 3.5, as compared to system 30A of FIG. 2A in which no lens 38C is present.

In some examples, antenna 36 emits a signal as spherical waves. Some of these spherical waves are received by lens 38C, which focuses the spherical waves towards waveguide 32, increasing the concentration of waves passing through waveguide 32. These spherical waves also pass through HDRs 40. Since the spherical waves have a frequency at or near to the resonance frequency of HDRs 40, HDRs 40 begin to resonate and form standing waves with large oscillating amplitudes. These resonances transfer energy between HDRs 40, and may even add energy to the wave, increasing the magnitude of the wave and replenishing power that was lost after emission by antenna 36. The spherical waves exit lens 38C and are received by waveguide 32 via port 34, where the waves are focused.

Figure 2D:
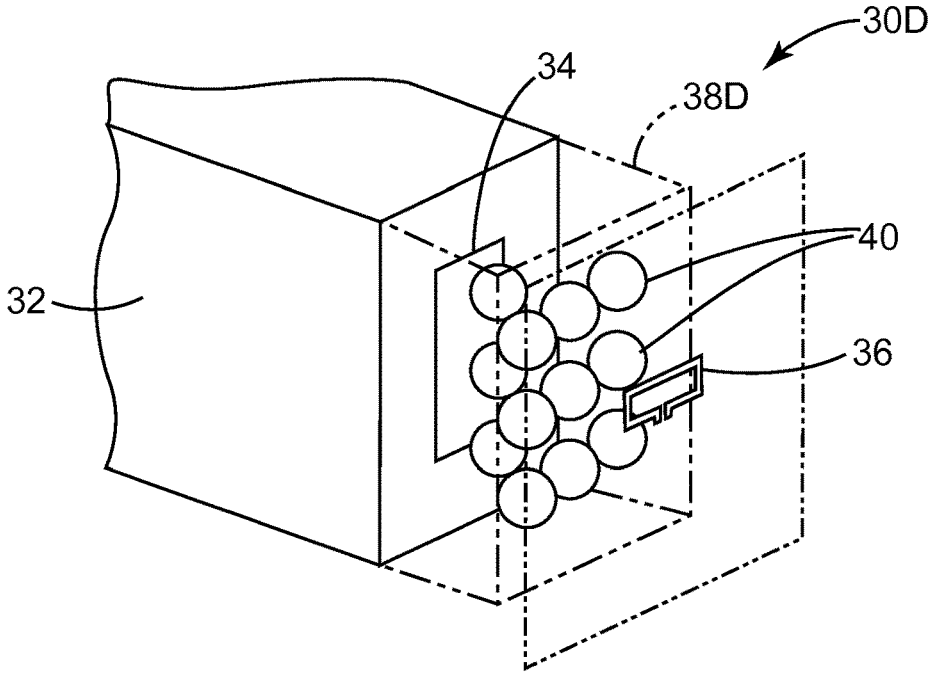

FIG. 2D is a block diagram illustrating an example waveguide system that includes a rectangular low relative permittivity material substrate lens 38D that includes a plurality of HDRs 40 arranged within lens 38D, in accordance with one or more techniques of this disclosure. In system 30D, lens 38D is formed in the shape of a three-dimensional rectangle, and is positioned between waveguide 32 and antenna 36. A first end of the rectangular lens 38D is proximate to port 34 of waveguide 32, with a second end of the rectangular lens 38D facing antenna 36. HDRs 40 are arranged within lens 38D, and HDRs 40 are configured to resonate at or near the same frequency as the electromagnetic waves emitted by antenna 36. HDRs 40 are formed of a material having a high permittivity relative to a permittivity of the substrate material of lens 38D. HDRs 40 are evenly spaced within lens 38D in such a way that, when HDRs 40 begin resonating due to incident waves having a frequency at or near to the resonance frequency of the HDRs 40, energy is transferred between the individual HDRs 40 towards waveguide 32. In some examples, this can more than triple the magnitude of waves passing through waveguide 32, as compared to system 30A of FIG. 2A without lens 38D.

Antenna 36 may emit a signal as spherical waves. Some of these spherical waves are received by lens 38D, which focuses the spherical waves towards waveguide 32, increasing the concentration of waves passing through waveguide 32. These spherical waves also pass through HDRs 40. Since the spherical waves have a frequency at or near to the resonance frequency of HDRs 40, HDRs 40 begin to resonate and form standing waves with large oscillating amplitudes. These resonances transfer energy between HDRs 40, and may add energy to the wave, increasing the magnitude of the wave and replenishing power that was lost after emission by antenna 36. The spherical waves exit lens 38D and are received by waveguide 32 via port 34, where the waves are focused.

FIGS. 3A-3D are conceptual diagrams illustrating example electromagnetic fields in different example systems, in accordance with one or more techniques of this disclosure. For example, the strength of the electromagnetic field is shown at different locations of various arrangements of a waveguide, a lens, and an antenna as electromagnetic waves pass through the waveguide according to testing. In these test examples, a waveguide measuring 2.5 mm×1.25 mm is used. The waveguide also has an Aluminum cladding that is 1 mm thick. In the examples in which a lens is used, the lens is made of Teflon® that is 2 mm in length. The lens is situated 1.35 mm away from the antenna. In this example, the HDRs have spherical shape and have a radius of 0.35 mm with a relative permittivity of 40 for a 60 GHz wave. The lattice constant, meaning the distance from the center of one HDR to the center of a neighboring HDR, is 1 mm. The antenna is emitting a 60 GHz electromagnetic wave with an initial electromagnetic field strength of 5.13e+03 V/m.

Figure 3A:
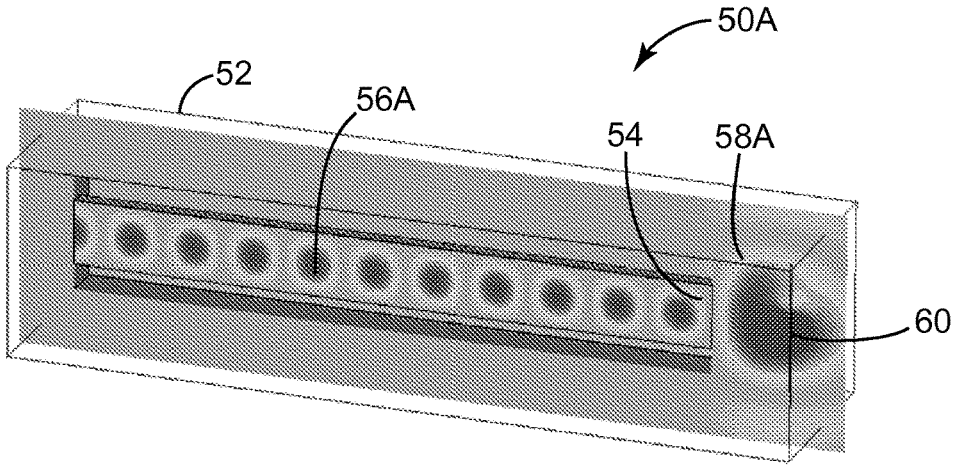
FIGS. 3A-3D are conceptual diagrams illustrating example electromagnetic fields in different example systems, in accordance with one or more techniques of this disclosure.

FIG. 3A is a conceptual diagram illustrating an example electromagnetic field for a waveguide system without any lens, such as system 30A of FIG. 2A, as electromagnetic waves pass through the waveguide, in accordance with one or more techniques of this disclosure. In this example system 50A, waveguide 52 has a port 54 at a first end revealing a hollow interior. This hollow interior runs the entire length of waveguide 52 and leads to another port at a second end of waveguide 52. Antenna 60 may emit a signal as spherical waves, for example. Antenna 60 may emit a signal as spherical waves, for example. Some of these spherical waves enter waveguide 52 through port 54, where they are focused to propagate in one direction to conserve energy. Many other spherical waves may be lost due to the manner in which antenna 60 emits signals, and the wave magnitude may decrease greatly due to spherical waves losing power proportionally to the square of the distance traveled when the waves are not focused.

In the example of system 50A, electromagnetic waves are emitted from antenna 60 and enter waveguide 52 through port 54. Once inside waveguide 52, the electromagnetic waves are focused and the strength of the electromagnetic field 56A of the waves remains constant. Electromagnetic field 56A has a small center measuring close to the maximum of 5.13e+03 V/m, but dissipates quickly as the distance from the center increases.

Figure 3B:
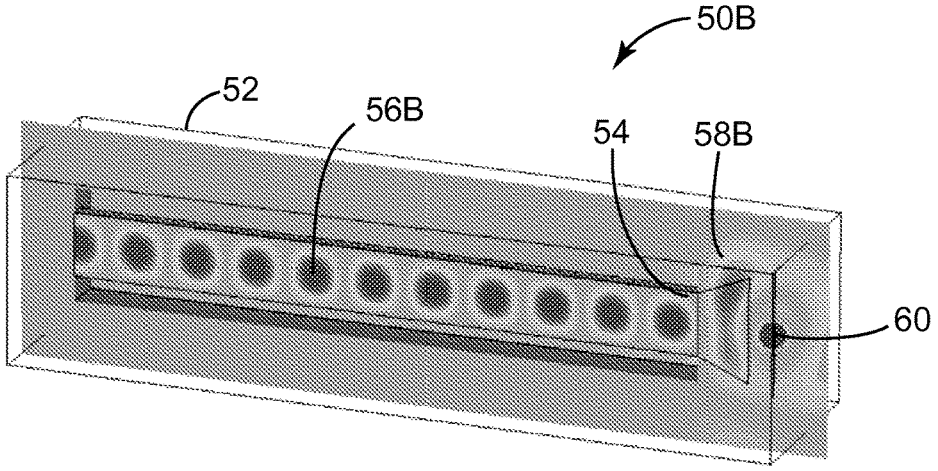

FIG. 3B is a conceptual diagram illustrating an example electromagnetic field for a waveguide system with a trapezoidal low relative permittivity material substrate lens but without a plurality of HDRs inside the lens, such as system 30B of FIG. 2B. In this system 50B, a low relative permittivity material substrate lens 58B in the shape of a three-dimensional trapezoid is now included in the system, coupling waveguide 52 to antenna 56. The tapered end of the trapezoidal lens 58B is proximate to port 54 of waveguide 52, with the larger end of the trapezoidal lens 58B proximate to antenna 56. Antenna 56 emits a signal as spherical waves. Some of these spherical waves are received by lens 58B, which focuses the spherical waves at or near port 54 of waveguide 52, increasing the magnitude of energy passing through waveguide 52 as compared to system 50A of FIG. 3A in which no lens 58B is present.

This increase in energy can be seen by electromagnetic field 56B. In the example of system 50B, electromagnetic waves are emitted from antenna 60 and enter waveguide 52 through port 54. Once inside waveguide 52, the electromagnetic waves are focused and the strength of the electromagnetic field 56B of the waves remains constant.

Figure 3C:
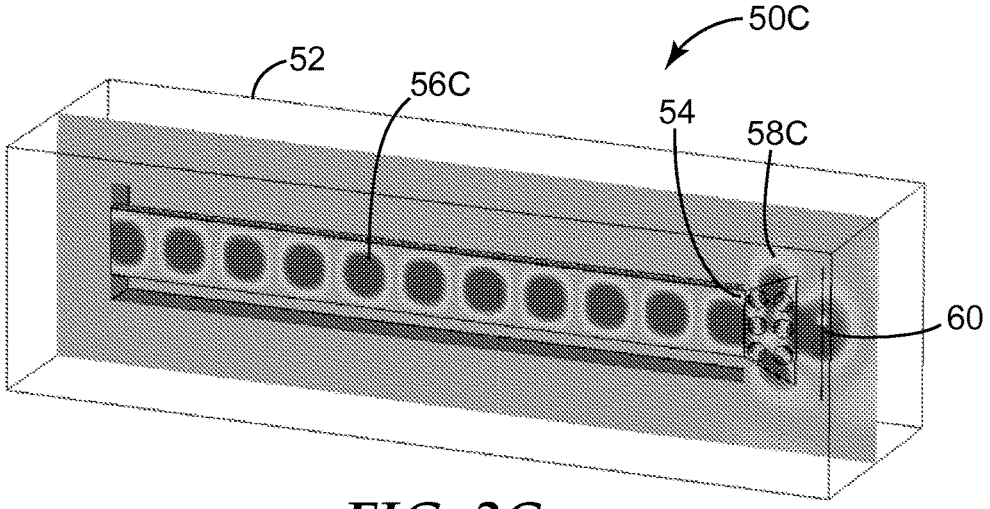

FIG. 3C is a conceptual diagram illustrating an example electromagnetic field for a waveguide system with a trapezoidal low relative permittivity material substrate lens and a plurality of HDRs arranged within the lens, such as system 30C of FIG. 2C, in accordance with one or more techniques of this disclosure. System 50C comprises waveguide 52, port 54, lens 58C, and antenna 60, configured in a way similar to that of system 30C in FIG. 2C. An increase in energy is shown in electromagnetic field 56C, relative to that of FIGS. 3A and 3B. In the example of system 50C, the portion of electromagnetic field 56C that is 5.13e+03 V/m is almost the entirety of electromagnetic field 56C. This increased potential difference across electromagnetic field 56C increases the magnitude of waves passing through waveguide 52 by a factor of almost 3.5, as compared to system 50A of FIG. 3A in which no lens 58C is present.

Figure 3D:
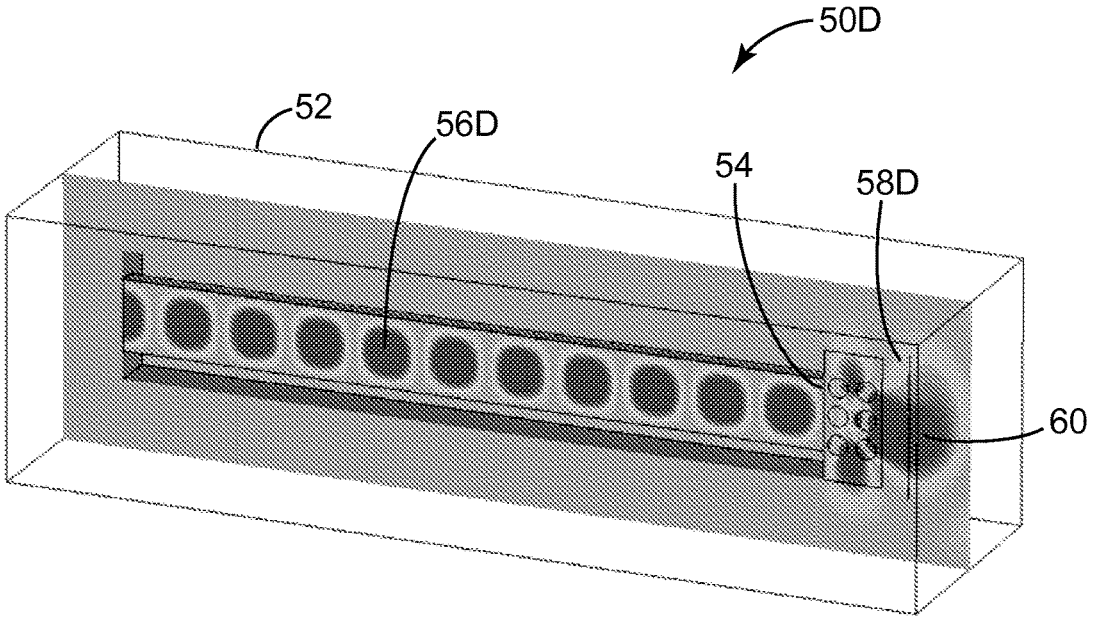

FIG. 3D is a conceptual diagram illustrating an example electromagnetic field for a waveguide system with a rectangular low relative permittivity material substrate lens and a plurality of HDRs dispersed within the lens, such as system 30D of FIG. 2D, in accordance with one or more techniques of this disclosure. System 50D comprises waveguide 52, port 54, lens 58D, and antenna 60, configured in a way similar to that of system 30D in FIG. 2D.

This increase in energy can be seen by electromagnetic field 56D. In the example of system 50C, the portion of electromagnetic field 56D that is 5.13e+03 V/m is almost the entirety of electromagnetic field 56D. This increased potential difference across electromagnetic field 56D increases the magnitude of waves passing through waveguide 52 by a factor of almost 3.5, as compared to system 50A of FIG. 3A in which no lens 58C is present.

Figure 4:
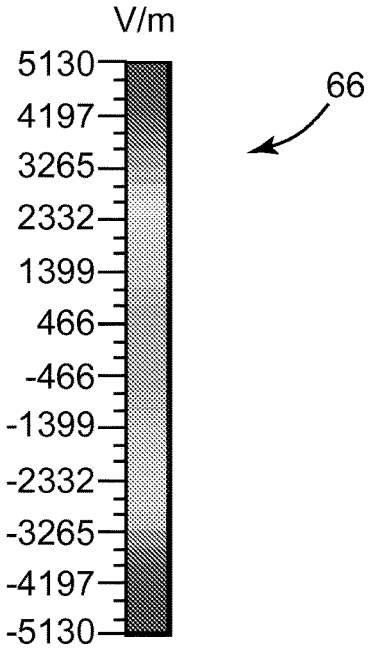
FIG. 4 is a block diagram illustrating a key for electromagnetic field strengths in block diagrams of FIGS. 3A-3D, in accordance with one or more techniques of this disclosure.

FIG. 4 is a block diagram illustrating a key for electromagnetic field strengths in block diagrams of FIGS. 3A-3D, in accordance with one or more techniques of this disclosure. Key 66 shows the variation in electromagnetic field strengths (e.g., electromagnetic fields 56A-56D) that could be present in any of the block diagrams in FIGS. 3A-3D. In this example, the electromagnetic field strengths are measured in V/m, or Volts per meter. Antenna 60 (in FIGS. 3A-3D) emits spherical waves initially having an electromagnetic field strength of 5.13e+03 V/m, which is shown as the maximum possible value in key 66. The gradient of key 66 shows the electromagnetic field strength decreasing at locations further down key 66.

Figure 5:
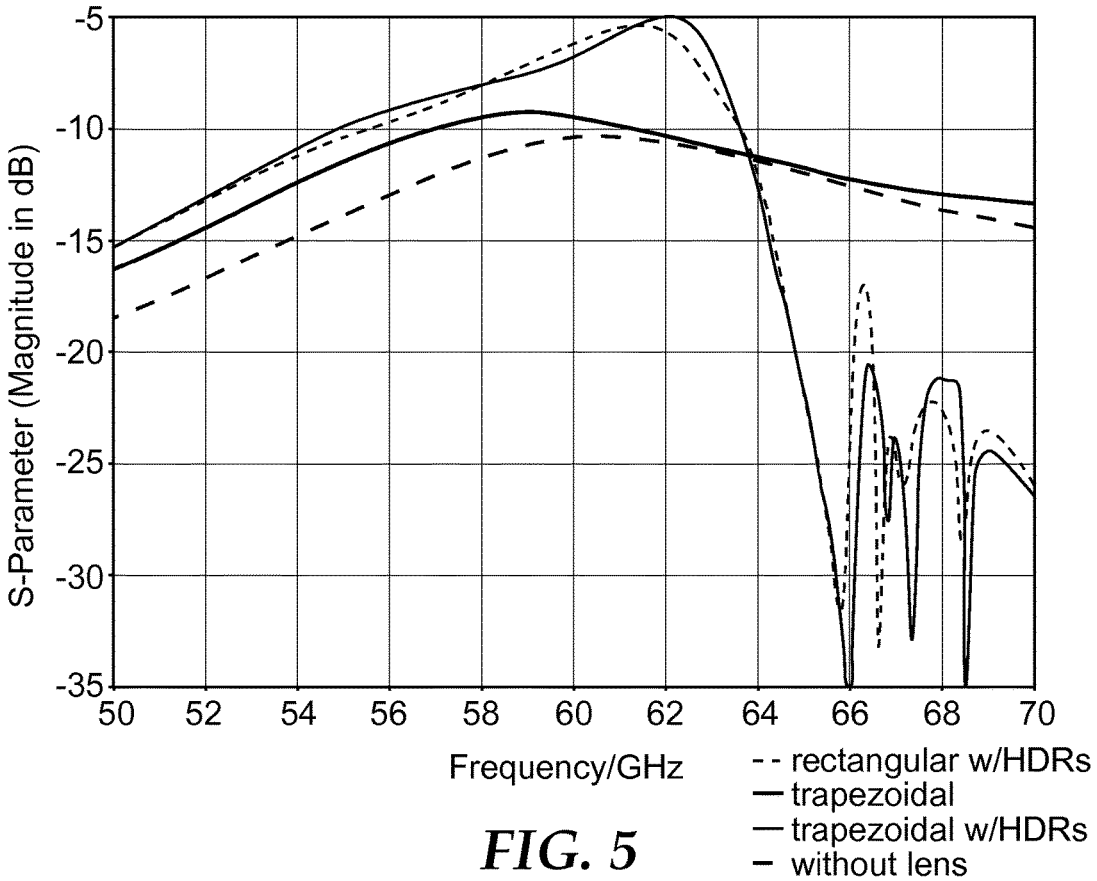
FIG. 5 is a graph illustrating magnitude of signals at different frequencies in different systems, in accordance with one or more techniques of this disclosure.

FIG. 5 is a graph illustrating magnitude of signals at different frequencies in different systems, in accordance with one or more techniques of this disclosure. FIG. 5 shows decibel magnitude (in dB) as a function of frequency (in GHz). For both a waveguide system with a rectangular lens with HDRs (e.g., system 30D of FIG. 2D) and waveguide system with a trapezoidal lens with HDRs (e.g., system 30C of FIG. 2C), the magnitude of the electromagnetic waves passing through the system is consistently greater than either the waveguide system with a trapezoidal lens only (e.g., system 30B of FIG. 2B) or a waveguide alone (e.g., system 30A of FIG. 2A). The maximum magnitudes and the corresponding power ratios were measured as follows:

TABLE 1

| | Without Lens | With trapezoidal Teflon ® lens | With trapezoidal Teflon ® lens and HDRs | With rectangular Teflon ® lens and HDRs |
|---|---|---|---|---|
| Maximum Magnitude (dB) | −10.4 | −9.4 | −5 | −5.4 |
| Maximum Power Ratio | .091 | .115 | .316 | .288 |

As seen in Table 1, adding a trapezoidal Teflon® lens with HDRs (e.g., trapezoidal lens 38C with HDRs 40 of FIG. 2C) adds more than 5 decibels to the electromagnetic waves propagating through the associated waveguide system when compared to a waveguide alone. This equates to multiplying the power ratio of the electromagnetic waves by almost 3.5. Adding a rectangular lens with HDRs (e.g., rectangular lens 38D with HDRs 40 of FIG. 2D) adds 5 decibels to the electromagnetic waves propagating through the associated waveguide system when compared to a waveguide alone, which more than triples the power ratio of the electromagnetic waves.

Figure 6A:
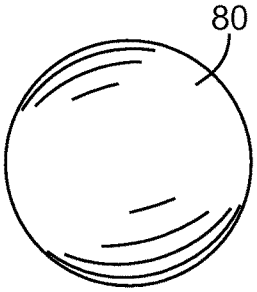
FIGS. 6A-6C are block diagrams illustrating various shapes that can be used for the structure of an HDR, according to one or more techniques of this disclosure.
Figure 6B:
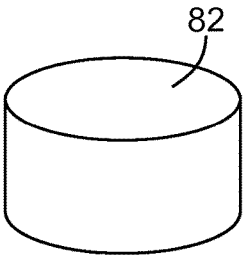
Figure 6C:
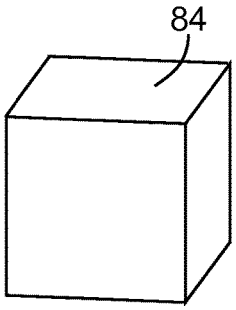

FIGS. 6A-6C are block diagrams illustrating various shapes that can be used for the structure of an HDR, according to one or more techniques of this disclosure. FIG. 6A illustrates an example of a spherical HDR, according to one or more techniques of the current disclosure. Spherical HDR 80 can be made of a variety of ceramic materials, for example, including BaZnTa oxide, BaZnCoNb, Zrtitanium-based materials, Titanium-based materials, Barium Titanate-based materials, Titanium oxide-based materials, Y5V, and X7R, for example, among other things. HDRs 82 and 84 of FIGS. 6B and 6C can be made of similar materials. Spherical HDR 80 is symmetrical, so the incident angles of the antenna and the emitted waves do not affect the system as a whole. The relative permittivity of HDR sphere 80 is directly related to the resonance frequency. For example, at the same resonance frequency, the size of HDR sphere 80 can be reduced by using higher relative permittivity material. The TM resonance frequency for HDR sphere 80 can be calculated using the following formula, for mode S and pole n:

$$f_{n,s}^{TM} \sim \frac{C}{2a\sqrt{\varepsilon_r}}\left(\frac{n-1}{2}+S\right)$$

The TE resonance frequency for HDR sphere 80 can be calculated using the following formula, for mode S and pole n:

$$f_{n,s}^{TE} \sim \frac{C}{2a\sqrt{\varepsilon_r}}\left(\frac{n}{2}+S\right)$$

where a is the radius of the spherical resonator.

FIG. 6B is a block diagram illustrating an example of a cylindrical HDR, according to one or more techniques of the current disclosure. Cylindrical HDR 82 is not symmetric about all axes. As such, the incident angle of the antenna and the emitted waves relative to cylindrical HDR 82 may have an effect of polarization on the waves as they pass through cylindrical HDR 82, depending on the incident angle, as opposed to the symmetrical spherical HDR 80 of FIG. 5A. The approximate resonant frequency of $TE_{01n}$ mode for an isolated cylindrical HDR 82 can be calculated using the following formula:

$$f_{GHz} = \frac{34}{a\sqrt{\varepsilon_r}}\left(\frac{a}{L}+3.45\right)$$

where a is the radius of the cylindrical resonator and L is its length. Both a and L are in millimeters. Resonant frequency $f_{GHZ}$ is in gigahertz. This formula is accurate to about 2% in the range: $0.5<a/L<2$ and $30<\varepsilon_r<50$.

FIG. 6C is a block diagram illustrating an example of a cubic HDR, according to one or more techniques of the current disclosure. Cubic HDR 84 is not symmetric about all axes. As such, the incident angle of the antenna and the emitted waves relative to cylindrical HDR 82 may have an effect of polarization on the waves as they pass through cubic HDR 84, as opposed to the symmetrical spherical HDR 80 of FIG. 5A. Approximately, the lowest resonance frequency for cubic HDR 84 is:

$$f = \frac{c}{\sqrt{2}\sqrt{\varepsilon_r}} \cdot \frac{1}{a}$$

where a is the cube side length and c is the light velocity in air.

Figure 7:
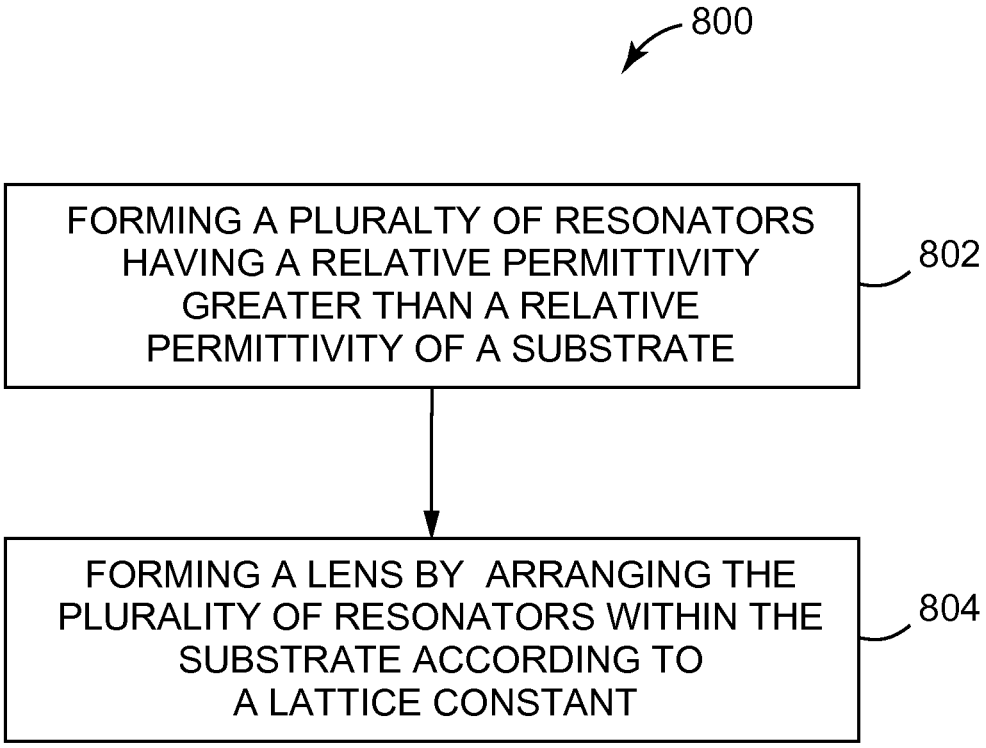
FIG. 7 is a flow diagram illustrating a method of forming a lens with a plurality of resonators, in accordance with one or more techniques of this disclosure.

FIG. 7 is a flow diagram illustrating steps for a method of forming a lens with a plurality of high dielectric resonators, in accordance with one or more techniques of this disclosure. In this method 800, a plurality of resonators (e.g., HDRs 18) may be formed, with each resonator in the plurality of resonators having a relative permittivity greater than a relative permittivity of a substrate (802). For example, the plurality of resonators may be formed of a dielectric material having a resonance frequency selected based at least in part on a frequency of an electromagnetic wave with which the lens is to be used. Each of the resonators may be formed to have a diameter that is selected based at least in part on a wavelength of the electromagnetic wave. A lens (e.g., lens 16) may be formed by arranging the plurality of resonators within the substrate material of the lens according to a lattice constant (804). The lattice constant defines a distance between a center of a first one of the resonators and a center of a neighboring second one of the resonators.

Various embodiments of the invention have been described. These and other embodiments are within the scope of the following claims.

The invention claimed is:

1. A lens comprising:

a substrate for propagating an electromagnetic wave, the substrate having a larger end and a tapered end opposing to the larger end; and a plurality of resonators dispersed throughout the substrate, wherein a number of resonators proximate to the larger end is greater than a number of resonators proximate to the tapered end, wherein each of the plurality of resonators has a diameter selected based at least in part on a wavelength of the electromagnetic wave and is formed of a dielectric material having a resonance frequency selected based at least in part on a frequency of the electromagnetic wave, wherein each of the plurality of resonators has a relative permittivity that is greater than a relative permittivity of the substrate, and wherein at least two of the plurality of resonators are spaced within the substrate according to a lattice constant that defines a distance between a center of a first one of the resonators and a center of a neighboring second one of the resonators.

2. The lens of claim 1, wherein the lattice constant is less than the wavelength of the electromagnetic wave.

3. The lens of claim 1, wherein the resonance frequency is selected to match the frequency of the electromagnetic wave.

4. The lens of claim 1, further wherein the lattice constant and the resonance frequency are selected based at least in part on the waveguide with which the lens is to be used.

5. The lens of claim 1, wherein a ratio of the diameter of the resonators to the lattice constant is less than one.

6. The lens of claim 1, wherein each of the plurality of resonators has a relative permittivity that is from at least two times greater than a relative permittivity of the substrate.

7. The lens of claim 1, wherein each of the plurality of resonators has a relative permittivity that is at least ten times greater than a relative permittivity of the substrate.

8. The lens of claim 1, wherein the resonance frequency of the plurality of resonators is within a millimeter wave band.

9. The lens of claim 1, wherein the resonance frequency of the plurality of resonators is 60 GHz.

10. The lens of claim 1, wherein the plurality of resonators are made of a ceramic material.

11. The lens of claim 1, wherein the plurality of resonators are made of one of BaZnTa oxide, BaZnCoNb, a Zrtitanium-based material, a Titanium-based material, a Barium Titanate-based material, a Titanium oxide-based material, Y5V, and X7R.

12. The lens of claim 1, wherein the substrate is made of one of Teflon®, quartz glass, cordierite, borosilicate glass, perfluoroalkoxy, polyethylene, and fluorinated ethylene propylene.

13. The lens of claim 1, wherein the plurality of resonators are formed having one of a spherical shape, a cylindrical shape, or a cubic shape.

14. A method of forming a lens having a substrate, the method comprising:

forming a plurality of resonators of a dielectric material having a resonance frequency selected based at least in part on a frequency of an electromagnetic wave with which the lens is to be used, wherein each of the resonators has a diameter that is selected based at least in part on a wavelength of the electromagnetic wave, wherein each of the plurality of resonators has a relative permittivity that is greater than a relative permittivity of the substrate, wherein the substrate has a larger end and a tapered ending opposing to the larger end; and arranging at least two of the plurality of resonators to be spaced within the substrate according to a lattice constant that defines a distance between a center of a first one of the resonators and a center of a neighboring second one of the resonators, wherein a number of resonators proximate to the larger end is greater than a number of resonators proximate to the tapered end.

15. The method of claim 14, further comprising selecting the lattice constant to be less than the wavelength of the electromagnetic wave.

16. The method of claim 1, further comprising selecting the resonance frequency to match the frequency of the electromagnetic wave.

17. The method of claim 1, further comprising selecting the lattice constant and the resonance frequency based at least in part on the waveguide with which the lens is to be used.

18. The method of claim 1, wherein a ratio of the diameter of the resonators to the lattice constant is less than one.

19. The method of claim 1, wherein each of the plurality of resonators has a relative permittivity that is from at least two times greater than a relative permittivity of the substrate.

20. A system comprising:

a waveguide;

an antenna; and a lens positioned between the antenna and the waveguide, wherein the lens comprises:

a substrate for propagating an electromagnetic wave sent or received by the antenna, the substrate having a larger end and a tapered end opposing to the larger end; and a plurality of resonators dispersed throughout the substrate, wherein a number of resonators proximate to the larger end is greater than a number of resonators proximate to the tapered end, wherein each of the plurality of resonators has a diameter selected based at least in part on a wavelength of the electromagnetic wave and is formed of a dielectric material having a resonance frequency selected based at least in part on a frequency of the electromagnetic wave, wherein each of the plurality of resonators has a relative permittivity that is greater than a relative permittivity of the substrate, and wherein at least two of the plurality of resonators are spaced within the substrate according to a lattice constant that defines a distance between a center of a first one of the resonators and a center of a neighboring second one of the resonators.

* * * * *